US009333754B2

(12) United States Patent
Ishii et al.

(10) Patent No.: US 9,333,754 B2
(45) Date of Patent: May 10, 2016

(54) LIQUID EJECTING APPARATUS AND CONTROL METHOD THEREOF

(71) Applicant: Seiko Epson Corporation, Shinjuku-ku (JP)

(72) Inventors: Hiroyuki Ishii, Shiojiri (JP); Hiroshige Owaki, Okaya (JP); Hiroaki Okui, Azumino (JP); Hiroyuki Hagiwara, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/637,990

(22) Filed: Mar. 4, 2015

(65) Prior Publication Data

US 2015/0251430 A1 Sep. 10, 2015

(30) Foreign Application Priority Data

Mar. 6, 2014 (JP) ..... 2014-044327

(51) Int. Cl.
*B41J 2/165* (2006.01)
*B41J 2/175* (2006.01)

(52) U.S. Cl.
CPC ..... *B41J 2/16523* (2013.01); *B41J 2/175* (2013.01)

(58) Field of Classification Search
CPC .. B41J 2/16508; B41J 2/1652; B41J 2/16523; B41J 2/16532; B41J 2/16547
USPC ..... 347/6, 20, 22, 29, 30, 84, 85
See application file for complete search history.

(56) References Cited

U.S. PATENT DOCUMENTS

2007/0291086 A1* 12/2007 Murakami et al. ..... 347/85
2011/0115844 A1* 5/2011 Ozawa ..... 347/28
2013/0233939 A1* 9/2013 Uezawa ..... 239/102.1

FOREIGN PATENT DOCUMENTS

JP 2009-184202 A 8/2009
JP 2011-161844 A 8/2011
JP 2011-206921 A 10/2011
JP 2012-086535 A 5/2012

* cited by examiner

*Primary Examiner* — Manish S Shah
*Assistant Examiner* — Roger W Pisha, II
(74) *Attorney, Agent, or Firm* — Kilpatrick Townsend & Stocton LLP

(57) ABSTRACT

A liquid ejecting apparatus includes a liquid ejecting head which includes a manifold; a first flow path and a second flow path which are connected to the manifold; a switching unit which switches a communication state between a liquid storage unit and the respective first and second flow paths; a pressure regulating unit which includes a valve which is open due to negative pressure on the manifold side of the first flow path; and a control unit which controls the switching unit, in which the control unit is capable of performing switching between a first mode in which liquid is supplied to the manifold through the valve and a second mode in which liquid is supplied to the manifold without going through the valve.

14 Claims, 15 Drawing Sheets

LIQUID EJECTING APPARATUS AND CONTROL METHOD THEREOF

CROSS-REFERENCE TO RELATED APPLICATIONS

This application claims priority to Japanese Patent Application No. 2014-044327 filed on Mar. 6, 2014. The entire disclosures of Japanese Patent Application No. 2014-044327 is hereby incorporated herein by reference.

BACKGROUND

1. Technical Field

The present invention relates to a liquid ejecting apparatus which includes a liquid ejecting head ejecting liquid from a nozzle opening, and a control method of the liquid ejecting apparatus.

2. Related Art

As a liquid ejecting apparatus which ejects liquid to a medium for ejecting, an ink jet recording apparatus which performs printing on paper, a recording sheet, or the like, which is a medium for ejecting by ejecting ink as a liquid is known.

An ink jet recording head which ejects ink from a nozzle opening which is used in such an ink jet recording apparatus includes an inflow port to which ink flows in, and an outflow port from which ink flows out, and is capable of circulating ink in the inside by causing the ink which flows in from the inflow port to flow out from the outflow port. In addition, it is possible to perform pressurizing circulation by providing a pressure-feeding unit such as a pressurizing pump, or the like, in a flow path which is connected to the inflow port.

In addition, in a case in which ink is supplied to the ink jet recording head through a pressure regulating valve by providing the pressure regulating valve in a flow path which supplies liquid to the ink jet recording head, it is not possible to supply pressurized ink since the pressure regulating valve is open due to negative pressure in a flow path on the downstream side. Accordingly, an ink jet recording apparatus with a configuration in which a different bypass flow path from the flow path having the pressure regulating valve is provided, and pressurized ink is supplied to the ink jet recording head through the bypass flow path, when performing pressurizing cleaning, has been proposed (for example, refer to JP-A-2011-161844).

However, when cleaning in the ink jet recording head using the pressure regulating valve is performed by pressurizing liquid, there is a problem in that air bubbles are pushed into corners of the flow path, and are not discharged from the flow path.

In addition, degrees of freedom in supplying of ink such as supplying of pressurized ink to the ink jet recording head using the pressure regulating valve, or supplying of ink by performing pressure regulation using the pressure regulating valve, without pressurizing ink are necessary.

In addition, such a problem is similarly present in a liquid ejecting apparatus which ejects liquid other than ink, not only in the ink jet recording apparatus.

SUMMARY

An advantage of some aspects of the invention is to provide a liquid ejecting apparatus in which variations in supplying liquid are increased by improving air bubble discharging properties, and a control method of the liquid ejecting apparatus.

According to an aspect of the invention, there is provided a liquid ejecting apparatus which includes a liquid ejecting head which communicates with a nozzle opening which ejects liquid, and includes individual flow paths which are arranged in a line along a first direction, and a manifold which communicates with a plurality of the individual flow paths; a first flow path which is connected to one end side of the first direction of the manifold; a second flow path which is connected to the other end side of the first direction of the manifold; a switching unit which switches a communication state between a liquid storage unit in which liquid is stored and the respective first and second flow paths; a pressure regulating unit which is provided between the switching unit of the first and second flow paths and the liquid ejecting head, and includes a valve which is open due to negative pressure on the manifold side of the first flow path; a pressure-feeding unit which sends liquid in a pressurizing manner toward the switching unit from the liquid storage unit; and a control unit which controls the switching unit, in which the control unit is capable of performing switching between a first mode in which liquid is supplied to the manifold through the valve by causing the liquid storage unit and the first flow path to communicate with the switching unit and a second mode in which liquid is supplied to the manifold without going through the valve by causing the liquid storage unit and the second flow path to communicate with the switching unit.

In the liquid ejecting apparatus, since it is possible to perform switching between a method in which liquid is supplied to the liquid ejecting head in a state in which pressure is regulated using the valve of the pressure regulating unit and a method in which liquid is supplied to the liquid ejecting head without going through the valve of the pressure regulating unit, it is possible to perform cleaning in a different supply state such as a cleaning time, and to improve an air bubble discharging property.

It is preferable that the liquid ejecting apparatus further includes a suctioning unit which suctions liquid from the nozzle opening, and the control unit performs a third mode in which liquid is discharged from the nozzle opening using the suctioning unit. In this manner, it is possible to perform cleaning in a different supply state such as a cleaning time, and to improve an air bubble discharging property.

In the liquid ejecting apparatus, it is preferable that the control unit determines whether or not to perform the second mode after performing the third mode. In this manner, it is possible to reliably perform filling of liquid and discharging of air bubbles by performing the second mode, and to suppress useless consumption of liquid without performing the second mode, when it is enough to perform only the third mode.

In the liquid ejecting apparatus, it is preferable that the control unit performs the third mode after supplying liquid to the second flow path using the second mode, when performing initial filling with respect to the liquid ejecting head. In this manner, it is possible to perform filling of liquid by increasing a flow rate without going through the valve, by supplying liquid using the second mode, and to effectively discharge air bubbles which are pushed into corners of the flow path, and are not discharged to the outside using suctioning, by performing the third mode, finally.

It is preferable that the liquid ejecting apparatus further includes a valve opening unit which opens the valve regardless of a pressure in the first flow path, and the control unit performs a fourth mode in which the valve is opened using the valve opening unit, liquid is supplied to the switching unit from the first flow path, and the liquid is supplied to the liquid ejecting head from the first flow path. In this manner, it is possible to supply liquid in a different supply method.

It is preferable that the liquid ejecting apparatus further includes a cap which seals the nozzle opening, and the control unit collects the liquid which is supplied from the first flow path to the liquid ejecting head from the second flow path by sealing the nozzle opening using the cap in a case of the fourth mode. In this manner, it is possible to supply liquid using another different supply method.

It is preferable that the liquid ejecting apparatus further includes a circulation pump, and the control unit allocates the liquid which is supplied from the first flow path to ejection of liquid from the nozzle opening of the liquid ejecting head, and to collection from the second flow path, in a case of the first mode. In this manner, it is possible to supply liquid using still another different method.

It is preferable that the liquid ejecting apparatus further includes a supply path and a collecting path which communicate with the switching unit and the liquid storage unit, and the switching unit performs switching between a first state in which the first flow path and the supply path are connected, a second state in which the first flow path and the collecting path are connected, and a third state in which the first flow path, and the supply path and the collecting path are not connected.

It is preferable that the liquid ejecting apparatus further includes the supply path and the collecting path which communicate with the switching unit and the liquid storage unit, and the switching unit performs switching between a fourth state in which the second flow path and the supply path are connected, a fifth state in which the second flow path and the collecting path are connected, and a sixth state in which the second flow path, and the supply path and the collecting path are not connected.

It is preferable that the liquid ejecting apparatus further includes a pressure-feeding unit which is provided between the switching unit and the liquid storage unit.

It is preferable that the liquid ejecting apparatus further includes a filter which is provided in the first flow path, and which eliminates foreign substances included in liquid.

In the liquid ejecting apparatus, it is preferable that the switching unit selects whether or not to cause the liquid storage unit and the second flow path to communicate with each other according to a type of liquid, in the first mode.

In the liquid ejecting apparatus, in the first mode, it is preferable that the switching unit causes the liquid storage unit and the second flow path to communicate with each other when an ingredient contained in liquid is easy to subside, and not cause the liquid storage unit and the second flow path to communicate with each other when an ingredient contained in liquid is not easy to subside.

According to another aspect of the invention, there is provided a control method of a liquid ejecting apparatus which includes a liquid ejecting head which communicates with a nozzle opening which ejects liquid, and includes individual flow paths which are arranged in a line along a first direction, and a manifold which communicates with a plurality of the individual flow paths; a first flow path which is connected to one end side of the first direction of the manifold; a second flow path which is connected to the other end side of the first direction of the manifold; a switching unit which switches a communication state between a liquid storage unit in which liquid is stored and the respective first and second flow paths; a pressure regulating unit which is provided between the switching unit of the first and second flow paths and the liquid ejecting head, and includes a valve which is open due to negative pressure on the manifold side of the first flow path; a pressure-feeding unit which sends liquid in a pressurizing manner toward the switching unit from the liquid storage unit; and a control unit which controls the switching unit, in which the control unit performs a control so that a first mode in which liquid is supplied to the manifold through the valve by causing the liquid storage unit and the first flow path to communicate with the switching unit and a second mode in which liquid is supplied to the manifold without going through the valve by causing the liquid storage unit and the second flow path to communicate with the switching unit can be switched.

In the control method of the liquid ejecting apparatus, since it is possible to perform switching between a method in which liquid is supplied to the liquid ejecting head in a state in which a pressure is regulated using the valve of the pressure regulating unit and a method in which liquid is supplied to the liquid ejecting head without going through the valve of the pressure regulating unit, it is possible to perform cleaning in a different supply state such as a cleaning time, and to improve an air bubble discharging property.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the present invention will be described in detail based on embodiments.

Embodiment 1

Figure 1:
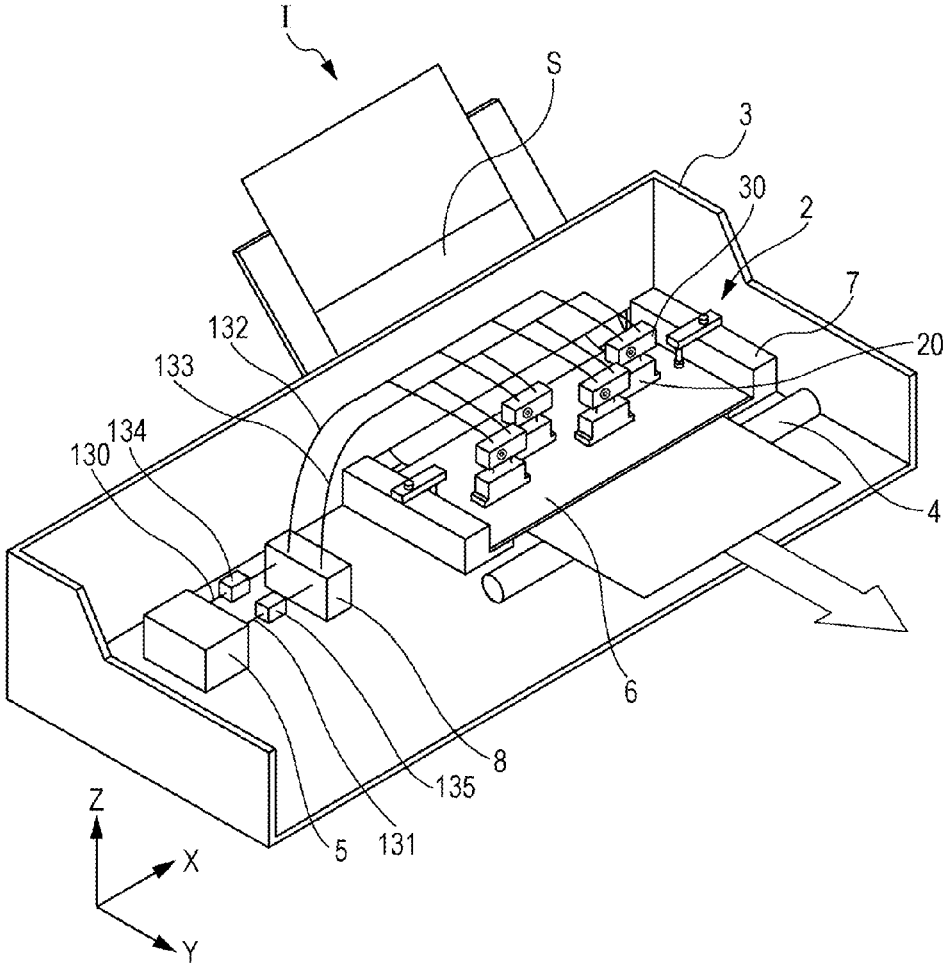
FIG. 1 is a schematic perspective view of a recording apparatus according to Embodiment 1.
Figure 2:
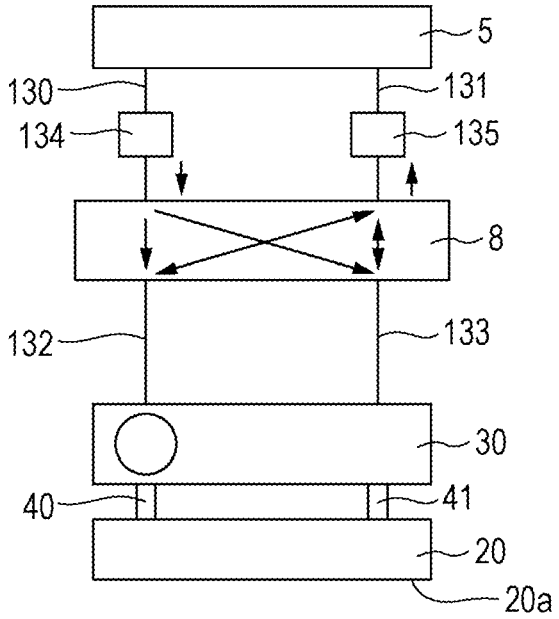
FIG. 2 is a diagram which schematically illustrates a configuration of a flow path of the recording apparatus according to the Embodiment 1.

FIG. 1 is a schematic perspective view of an ink jet recording apparatus as an example of a liquid ejecting head according to Embodiment 1 of the present invention, and FIG. 2 is a diagram which schematically illustrates a configuration of a flow path of the ink jet recording apparatus.

An ink jet recording apparatus I according to the embodiment is a so-called line-type ink jet recording apparatus in which an ink jet recording head 20 is fixed to an apparatus main body, and printing is performed with respect to a medium for ejecting by transporting the medium for ejecting such as a recording sheet in a direction orthogonal to an aligning direction of a nozzle opening 21.

Specifically, as illustrated in FIG. 1, the ink jet recording apparatus I includes an ink jet recording head unit 2 which includes the ink jet recording head 20, an apparatus main body 3, a transport roller 4 which feeds a recording sheet S as the medium for ejecting, and a liquid storage unit 5.

The ink jet recording head unit 2 (hereinafter, also referred to as head unit 2) includes a plurality of ink jet recording heads 20, and a plate-shaped base plate 6 which holds the plurality of ink jet recording heads 20. The head unit 2 is fixed to the apparatus main body 3 through a frame member 7 which is attached to the base plate 6.

In addition, a transport roller 4 as a transport unit is provided in the apparatus main body 3, and a recording sheet S which is a recording medium such as paper is transported using the transport roller 4. In addition, the transport unit for transporting the recording sheet S may be a belt, a drum, or the like, without being limited to the transport roller 4.

In addition, a liquid storage unit 5 for storing ink by being fixed to the apparatus main body 3 is connected to each ink jet recording head 20 through a switching unit 8.

The liquid storage unit 5 and the switching unit 8 are connected to each other using a supply pipe 130 in which a supply path 100 is provided, and a collecting pipe 131 in which a collecting path 101 is provided. In the supply pipe 130 and the collecting pipe 131, it is possible to use a flexible tube which is deformable plumbing, rigid plumbing which is formed using a resin, metal, or the like.

In addition, the switching unit 8 and the ink jet recording head 20 are connected using a first flow path member 132 in which a first flow path unit 110 is provided, and a second flow path member 133 in which a second flow path unit 120 is provided. It is possible to use a flexible tube which is deformable plumbing, rigid plumbing which is formed using a resin, metal, or the like, for example, in such a first flow path member 132 and a second flow path member 133.

In addition, the switching unit 8 can switch a connection state between the supply path 100 and the collecting path 101, and the first flow path unit 110 and the second flow path unit 120, and for example, it is possible to use an electromagnetic valve, or the like, which can perform switching using an electromagnetic force. Specifically, the switching unit 8 can perform switching of three connection states with respect to the first flow path unit 110. That is, the switching unit 8 can perform switching of a first state in which the first flow path unit 110 and the supply path 100 are connected, a second state in which the first flow path unit 110 and the collecting path 101 are connected, and a third state in which the first flow path unit 110, and the supply path 100 and the collecting path 101 are not connected. In addition, the switching unit 8 can perform switching of the three connection states with respect to the second flow path unit 120. That is, the switching unit 8 can perform switching of a fourth state in which the second flow path unit 120 and the supply path 100 are connected, a fifth state in which the second flow path unit 120 and the collecting path 101 are connected, and a sixth state in which the second flow path unit 120, and the supply path 100 and the collecting path 101 are not connected. In addition, as the switching unit 8, a unit in which electromotive power such as a motor is used, a unit in which pressure such as oil pressure is used, or the like, may be used without being limited to the electromagnetic valve.

In addition, a pressure regulating unit 30 is provided in each ink jet recording head 20 between the switching unit 8 and the ink jet recording head 20. The pressure regulating unit 30 will be described in detail later; however, the pressure regulating unit is a unit for regulating pressure of ink which will be supplied to the ink jet recording head 20 from the liquid storage unit 5.

In addition, a pressurizing pump 134 as a pressure-feeding unit is provided in the supply pipe 130 between the switching unit 8 and the liquid storage unit 5. Ink from the liquid storage unit 5 passes through the supply path 100 of the supply pipe 130 due to pressure of the pressurizing pump 134, and is supplied to the ink jet recording head 20 through the switching unit 8. In addition, in the embodiment, the pressurizing pump 134 as the pressure-feeding unit is provided; however, there is no particular limitation to this, and ink may be fed in a pressurizing manner using a water head difference, by adjusting a height in the vertical direction of the liquid storage unit 5 and the ink jet recording head 20.

In addition, a suctioning pump 135 is provided in the collecting pipe 131 between the switching unit 8 and the liquid storage unit 5. Ink which is not ejected from the ink jet recording head 20 is collected in the liquid storage unit 5 by passing through collecting path 101 of the collecting pipe 131 through the switching unit 8.

In addition, though it is not particularly illustrated, in the ink jet recording apparatus I according to the embodiment, a suctioning unit 9 which discharges ink by suctioning the ink from the nozzle opening 21 of each ink jet recording head 20, and a valve opening unit 10 which opens a pressure regulating valve of the ink jet recording head 20 are provided. The suctioning unit 9 and the valve opening unit 10 will be described later in detail.

In addition, though it is not particularly illustrated, in the ink jet recording apparatus I according to the embodiment, a control unit 11 which controls transporting of a recording sheet S, or ejecting of ink droplets from the ink jet recording head 20 based on a printing signal, and controls the switching unit 8, the suctioning unit 9, the valve opening unit 10, and the like, is provided.

Figure 3A:
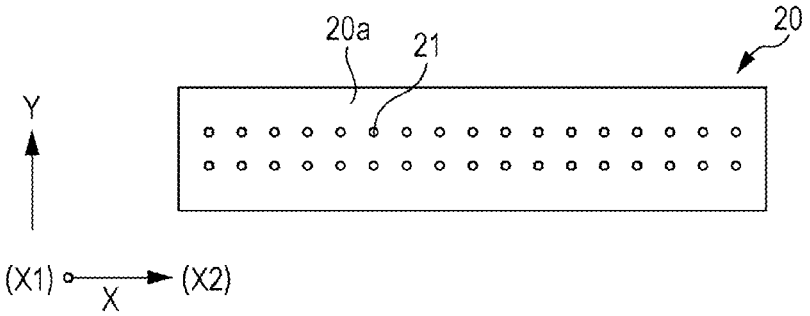
FIGS. 3A and 3B are plan views of a recording head and a pressure regulating unit according to the Embodiment 1.
Figure 3B:
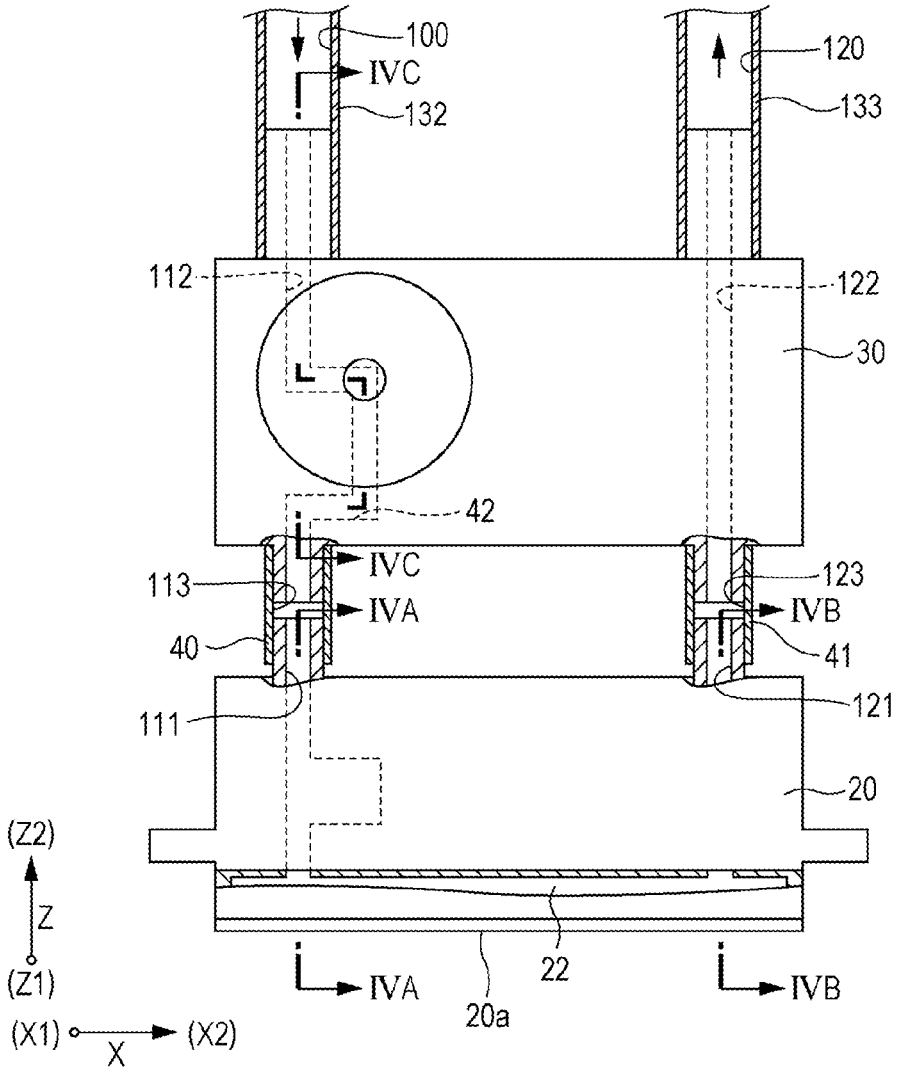
Figure 4A:
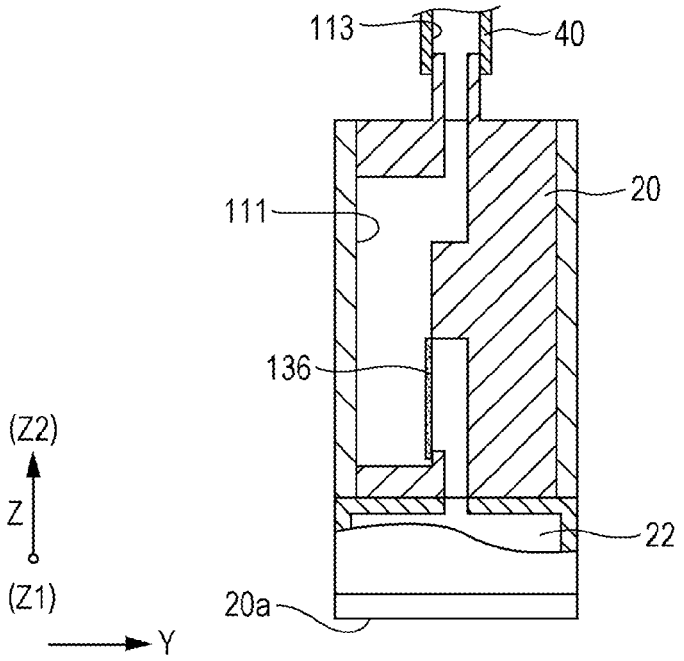
FIGS. 4A and 4B are cross-sectional views of the recording head according to the Embodiment 1.
Figure 4B:
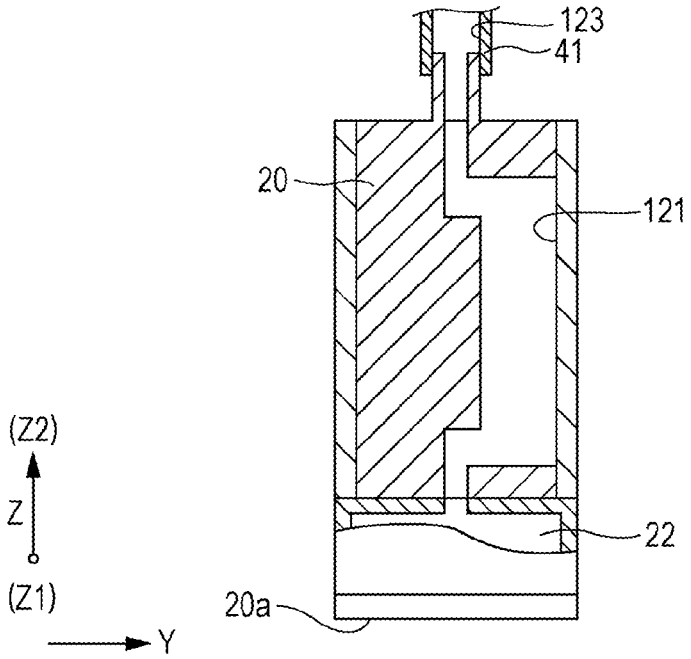
Figure 5:
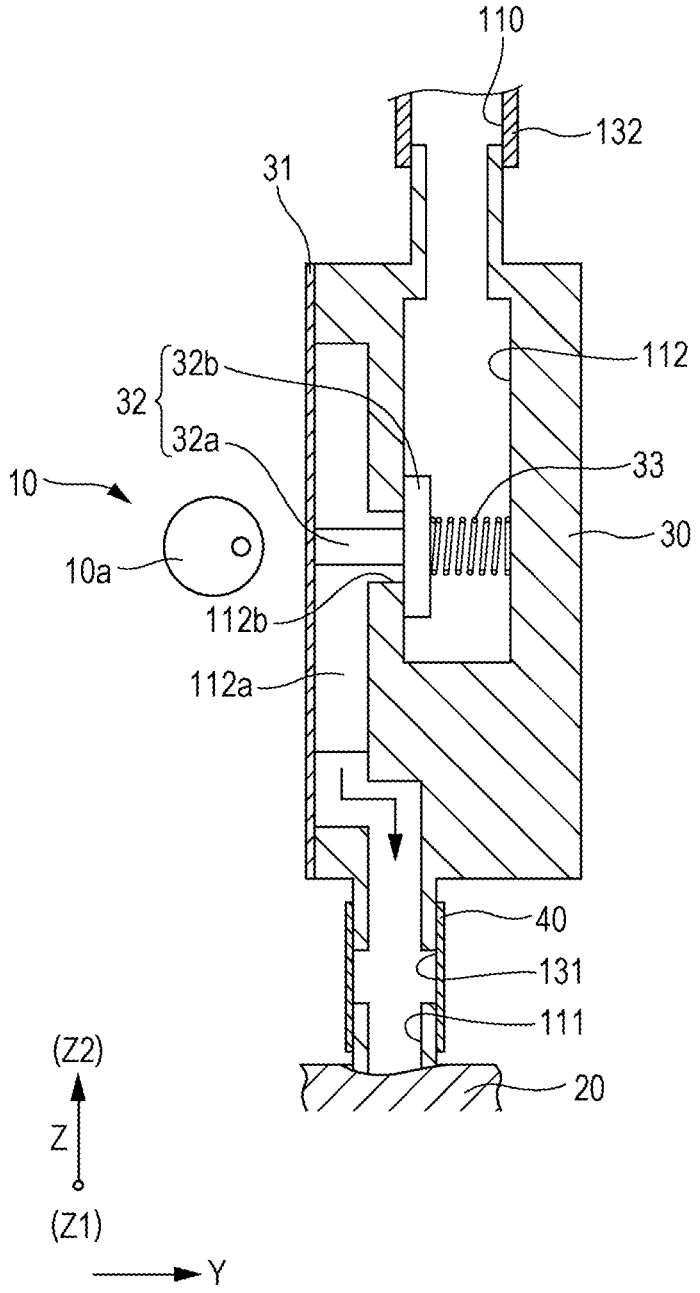
FIG. 5 is a cross-sectional view of a pressure regulating unit according to the Embodiment 1.
Figure 6:
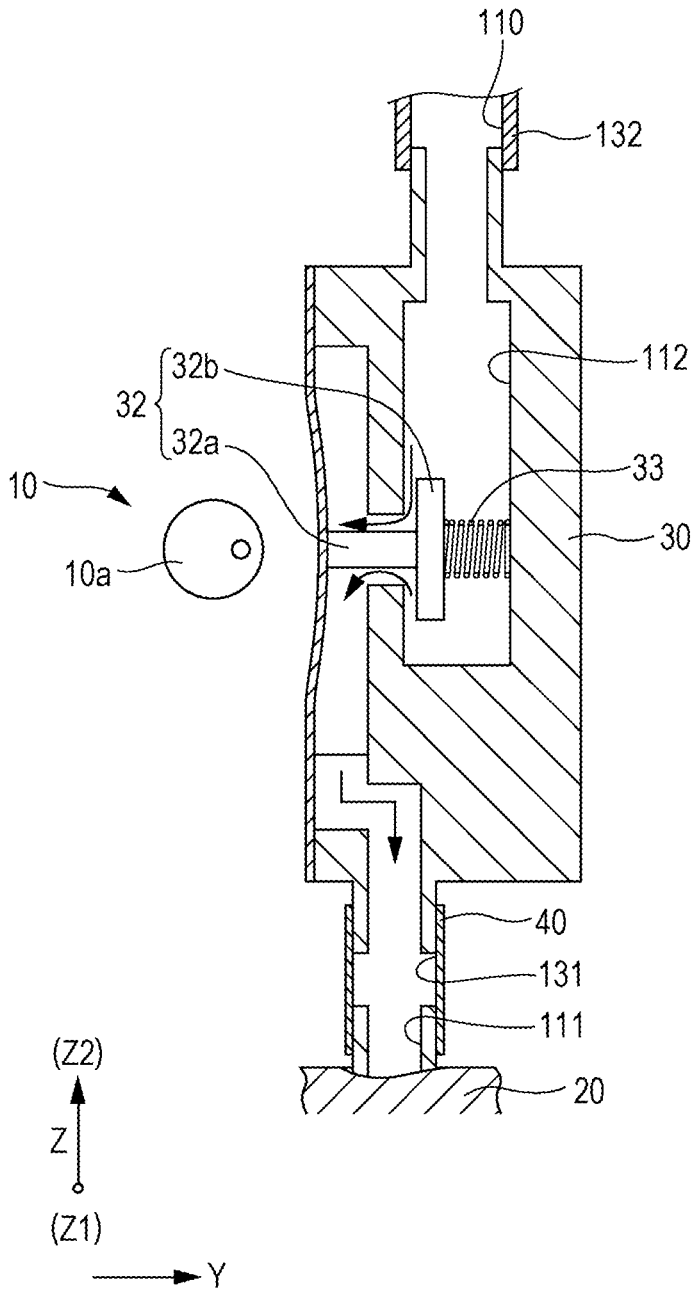
FIG. 6 is a cross-sectional view which illustrates operations of the pressure regulating unit according to the Embodiment 1.
Figure 7:
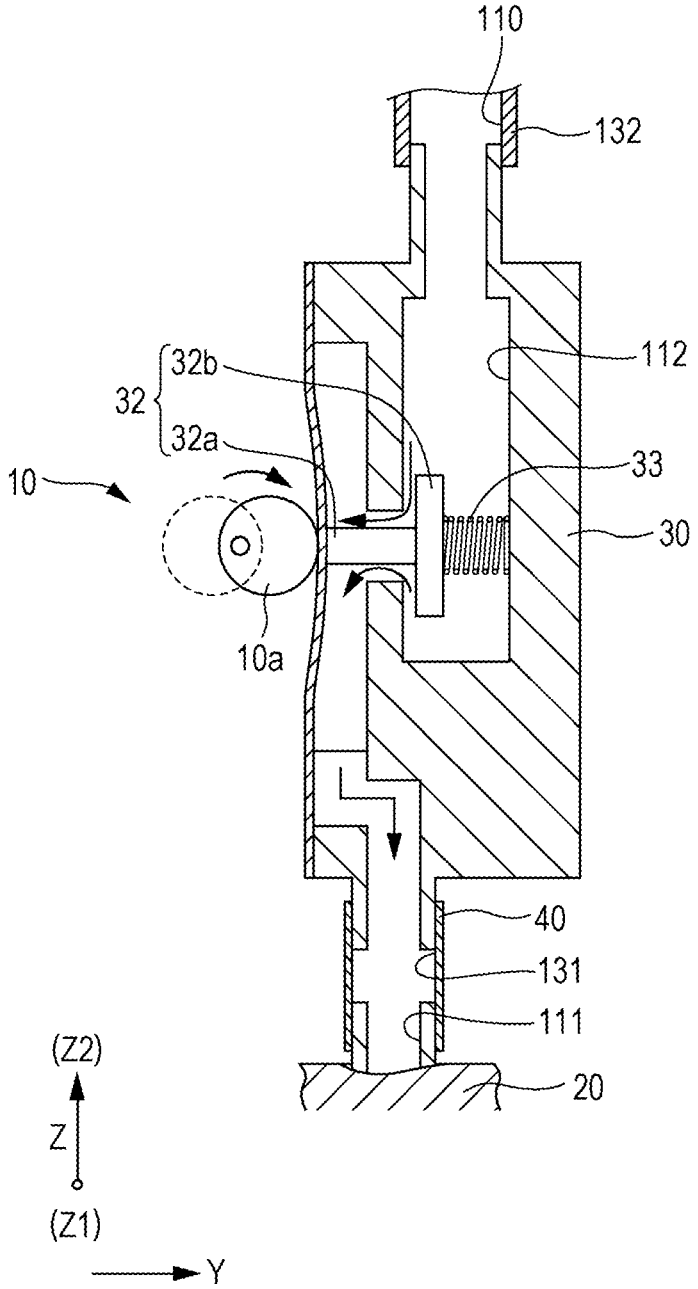
FIG. 7 is a cross-sectional view which illustrates operations of the pressure regulating unit according to the Embodiment 1.

Here, an example of the ink jet recording head which is mounted on such an ink jet recording apparatus I will be described. In addition, FIGS. 3A and 3B are a plan view of the ink jet recording head and the pressure regulating unit, and a plan view in which main portions are cut out. FIG. 4A is a cross-sectional view which is taken along line IVA-IVA in FIG. 3B, and FIG. 4B is a cross-sectional view which is taken along line IVB-IVB in FIG. 3B, FIG. 5 is a cross-sectional view which is taken along line IVC-IVC in FIG. 3B, and FIGS. 6 and 7 are cross-sectional views which are also taken along line IVC-IVC which illustrate operations of the pressure regulating unit.

As illustrated in FIGS. 3A to 4B, the ink jet recording head 20 includes a liquid ejecting face 20*a* on which the plurality of nozzle openings 21 are provided on one face. Specifically, the nozzle openings 21 which eject ink are provided in a line in the ink jet recording head 20. According to the embodiment, the aligning direction of the nozzle opening 21 is set to a first direction X. In addition, two of the columns of the nozzle opening 21 which are aligned in the first direction X are aligned in a second direction Y which is orthogonal to the first direction X. In addition, according to the embodiment, a direction which is orthogonal to the first direction X and the second direction Y is referred to as a third direction Z, and the liquid ejecting face 20*a* side is referred to as a Z1 side with respect to the pressure regulating unit 30, and the pressure regulating unit 30 side which is a face side opposite to the liquid ejecting face 20*a* is referred to as a Z2 side.

An individual flow path (not illustrated) which communicates with each nozzle opening 21 is provided inside the ink jet recording head 20, and ink is ejected from the nozzle opening 21 when a pressure is applied to ink in each individual flow path using a pressure generation unit (not illustrated) which is provided in the individual flow path. In addition, the plurality of individual flow paths are provided so as to communicate with a manifold 22 which is a common flow path. In addition, as a pressure generation unit, for example, there is a vertical vibration-type piezoelectric element, a deflection vibration-type piezoelectric element, a heating element, a unit in which an electrostatic force is used, or the like.

The manifold 22 is provided along the first direction X of the ink jet recording head 20. In addition, a plurality of the manifolds 22 may be provided by being divided in the first direction X, or a plurality of the manifolds may be provided by being divided in the second direction Y.

In the ink jet recording head 20, a third flow path unit 111 which communicates with one end side of the manifold 22 in the first direction X, and a fourth flow path unit 121 which communicates with the other end side of the manifold 22 in the first direction X are provided. According to the embodiment, in the first direction X, the one end side to which the third flow path unit 111 of the manifold 22 is connected is referred to as the X1 side, and the other end side to which the fourth flow path unit 121 is connected is referred to as the X2 side.

In addition, the filter 136 for eliminating foreign substances such as air bubbles or waste which is included in ink is provided in the third flow path unit 111. Ink which passes through the third flow path unit 111 is supplied to the manifold 22 in a state in which foreign substances thereof are eliminated using the filter 136.

In addition, the third flow path unit 111 and the fourth flow path unit 121 are provided in a state in which an end portion on the side opposite to an end portion to which the manifold 22 is connected is open to a face on the Z2 side which is the side opposite to the liquid ejecting face 20*a* of the ink jet recording head 20 in the third direction Z.

The pressure regulating unit 30 is connected to the third flow path unit 111 and the fourth flow path unit 121 of the ink jet recording head 20 through a first connecting pipe 40 and a second connecting pipe 41, respectively.

As illustrated in FIGS. 3A, 3B and 5, the pressure regulating unit 30 is provided on the Z2 side which is the side opposite to the liquid ejecting face 20*a* of the ink jet recording head 20, and includes a fifth flow path unit 112 which communicates with the third flow path unit 111 of the ink jet recording head 20, and a sixth flow path unit 122 which communicates with the fourth flow path unit 121 of the ink jet recording head 20.

The fifth flow path unit 112 is provided on the X1 side in the first direction X, and the fifth flow path unit 112 communicates with the third flow path unit 111 of the ink jet recording head 20 through a first connecting flow path 113 which is provided inside the first connecting pipe 40.

In addition, a valve which is open and shut due to pressure on the ink jet recording head 20 side of the fifth flow path unit 112 is provided in the middle of the fifth flow path unit 112 of the pressure regulating unit 30. Specifically, the fifth flow path unit 112 includes a pressure chamber 112*a* in a concave shape which is open to the surface of the pressure regulating unit 30. The upstream side of the pressure chamber 112*a* of the fifth flow path unit 112, that is, the side opposite to the ink jet recording head 20 is provided inside the pressure regulating unit 30 in the thickness direction, and communicates with a base of the pressure chamber 112*a* through a through hole 112*b*. In addition, the downstream side of the pressure chamber 112*a* of the fifth flow path unit 112, that is, the ink jet recording head 20 side is formed in a concave shape on the surface of the pressure regulating unit 30, similarly to the pressure chamber 112*a*, and is provided in a region which is connected to the first connecting flow path 113 in the inside in the thickness direction. The fifth flow path unit 112 which is open to the surface including the pressure chamber 112*a* is sealed with a flexible film 31 which is fixed to the surface of the pressure regulating unit 30.

In addition, a valve 32 is provided in the pressure chamber 112*a*. The valve 32 is formed of a shaft portion 32*a*, and a disk unit 32*b* which is provided integrally with the shaft portion on one end side of the shaft portion 32*a*, and the shaft portion 32*a* is inserted into a through hole 112*b* which is formed in the pressure chamber 112*a*. In addition, the other end portion on the opposite side to one end portion at which the disk unit 32*b* of the valve 32 is provided by being in contact with the film 31 through a pressure receiving plate (not illustrated), or the like. The disk unit 32*b* of the valve 32 has an outer diameter which is larger than an inner diameter of the through hole 112*b*. In addition, a spring 33 is provided between a rear face of the disk unit 32*b* (opposite side to film 31) and a wall face of the fifth flow path unit 112, and the valve 32 is urged to the film 31 side due to the spring 33, and the fifth flow path unit 112 is closed when the disk unit 32*b* closes the through hole 112*b*.

In the valve 32, as illustrated in FIG. 6, when negative pressure acts in the pressure chamber 112*a*, the film 31 deforms on the pressure chamber 112*a* side due to a pressure difference between the negative pressure in the pressure chamber 112*a* and an outside pressure in the outside of the pressure chamber 112*a* which is separated using the film 31, and the deformation is transmitted to the valve 32. That is, when there is a difference in pressure against an urging force of the spring 33 between a pressure (negative pressure) of the pressure chamber 112*a* and an outside pressure, the film 31 deforms on the pressure chamber 112*a* side. Due to this, the valve 32 is moved against the urging force of the spring 33, a gap is formed between the peripheral portion of the through hole 112*b* and the disk unit 32*b*, and the fifth flow path unit 112 is opened.

Meanwhile, as illustrated in FIGS. 3A and 3B, the sixth flow path unit 122 is provided on the X2 side of the pressure regulating unit 30 in the first direction X, and one end on the Z1 side communicates with the fourth flow path unit 121 of the ink jet recording head 20 through the second connecting flow path 123 which is provided in the second connecting pipe 41. In addition, the other end portion of the sixth flow path unit 122 is provided by being open to a face on the Z2 side which is the side opposite to the ink jet recording head 20 of the pressure regulating unit 30.

In addition, a valve opening unit 10 which forcibly opens the valve 32 of the pressure regulating unit 30 is provided in the pressure regulating unit 30 according to the embodiment. The valve opening unit 10 according to the embodiment includes a cam 10*a* which can eccentrically rotate, and a driving unit (not illustrated) such as a motor which rotates the cam 10*a*.

The cam 10*a* is arranged on a face side which is opposite to the shaft portion 32*a* of the valve 32 of the film 31. In addition, when the cam 10*a* is eccentrically rotated using the driving unit (not illustrated), as illustrated in FIG. 7, the cam 10*a* presses the shaft portion 32*a* of the valve 32 from the outer side of the film 31 against the urging force of the spring 33. In this manner, a gap is formed between the peripheral portion of the through hole 112*b* and the disk unit 32*b*, and the third flow path unit 111 is opened. That is, the valve opening unit 10 can open the valve 32 by forcibly moving the valve, regardless of the pressure of the pressure chamber 112*a*.

In addition, according to the embodiment, the valve opening unit 10 which is formed of the cam 10*a* which can eccentrically rotate, and the driving unit (not illustrated) which rotates the cam 10*a* is provided; however, there is no particular limitation in the valve opening unit 10 when it is possible to move the valve 32 regardless of the pressure of the pressure chamber 112*a*, and to open the third flow path unit 111, and for example, as the valve opening unit 10, it is also possible to use a unit which opens the valve by moving a magnetic body using electromagnetic force, by providing the magnetic body on the surface of the film 31 or in the valve 32, a unit which presses the surface of the film 31 using a pin which reciprocates using pressure such as oil pressure and air pressure, or power using a motor, or the like.

In this manner, according to the embodiment, the first flow path unit 110, the fifth flow path unit 112, the first connecting flow path 113, and the third flow path unit 111 from the switching unit 8 to the manifold 22 of the ink jet recording head 20 are referred to as the first flow path, and the second flow path unit 120, the sixth flow path unit 122, the second connecting flow path 123, and the fourth flow path unit 121 are referred to as the second flow path. That is, the pressure regulating unit 30 is provided in the middle of the switching unit 8 of the first flow path and the second flow path and the ink jet recording head 20, and the valve 32 which is open due to negative pressure on the manifold 22 side of the first flow path is provided in the middle of the first flow path.

Figure 8:
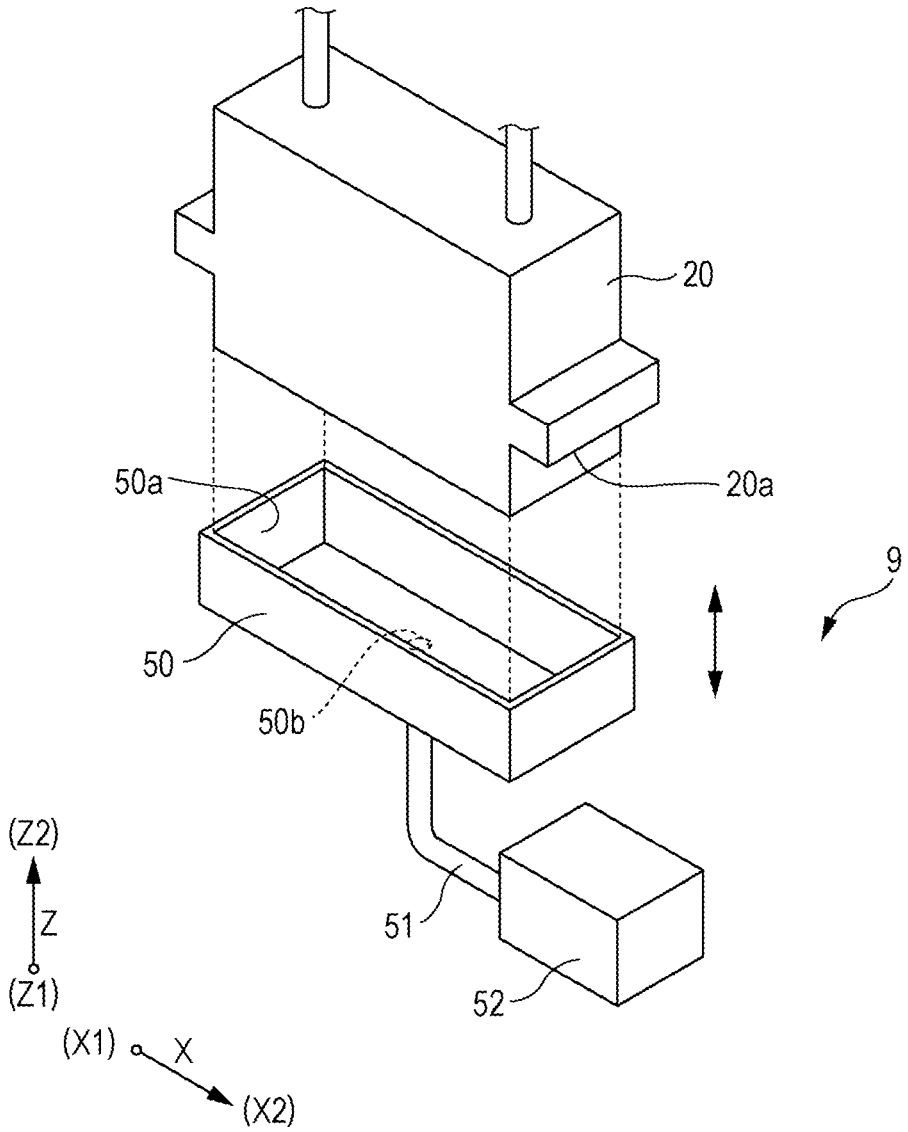
FIG. 8 is a perspective view of a suctioning unit according to the Embodiment 1.
Figure 9:
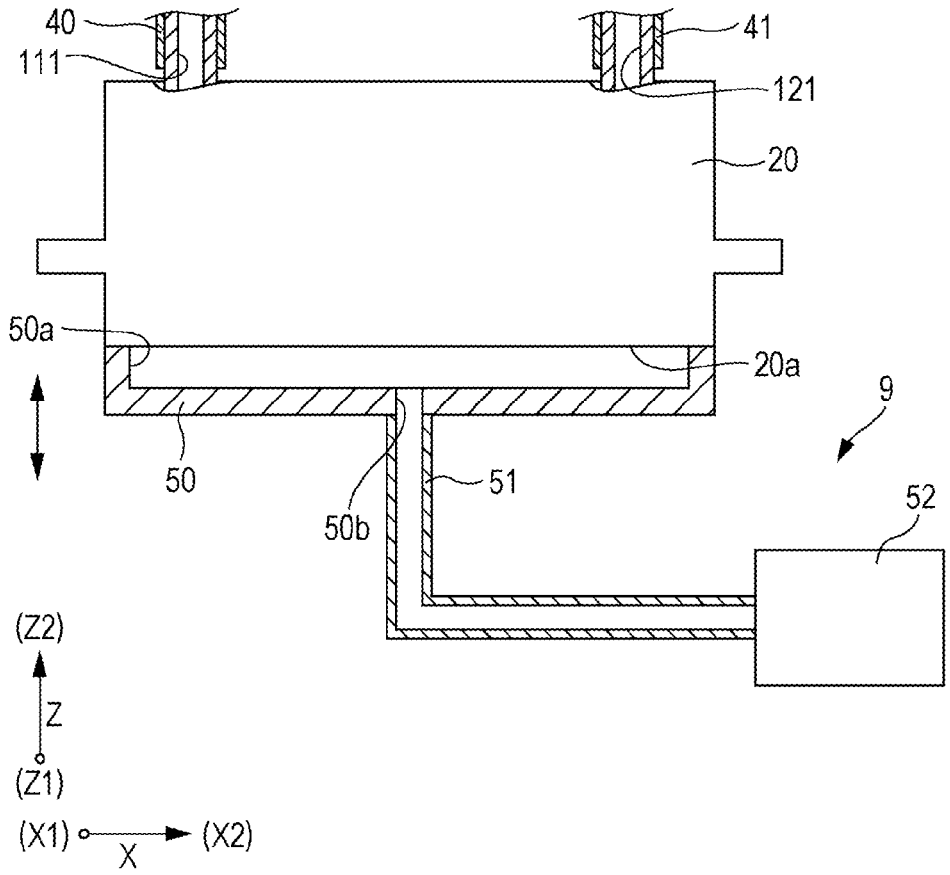
FIG. 9 is a plan view in which main portions of the suctioning unit according to the Embodiment 1 are cut out.

Here, the suctioning unit 9 which suctions ink from the nozzle opening 21 of the ink jet recording head 20 will be described. FIG. 8 is a perspective view of the suctioning unit, and FIG. 9 is a plan view in which main portions of the suctioning unit are cut out.

As illustrated, the suctioning unit 9 includes a suctioning cap 50 which covers the nozzle opening 21, and a suctioning device 52 such as a vacuum pump, for example, which is connected to the suctioning cap 50 through a tube 51.

The suctioning cap 50 is provided so as to face the liquid ejecting face 20*a* of the ink jet recording head 20, and is provided so as to cover all of the plurality of nozzle openings 21. Specifically, the suctioning cap 50 includes a suctioning port 50*a* which is open to all the nozzle openings 21 by facing the liquid ejecting face 20*a*. When an edge portion of the suctioning port 50*a* comes into contact with the liquid ejecting face 20*a*, the suctioning cap 50 covers all of the nozzle openings 21. In addition, the suctioning cap 50 includes a communication port 50*b* which communicates with the suctioning port 50*a* on a face on the side opposite to the suctioning port 50*a*, and the suctioning device 52 is connected to the communication port 50*b* through the tube 51.

In such a suctioning cap 50, the edge portion of the suctioning port 50*a* comes into contact with the liquid ejecting face 20*a*, and suctioning of ink using the suctioning device 52 is used in the suctioning cleaning operation in which ink in the flow path of the ink jet recording head 20 (first flow path or second flow path) is suctioned through the nozzle opening 21, and foreign substances such as air bubbles are discharged. In addition, the suctioning cap 50 takes a role of suppressing drying and thickening of ink in the vicinity of the nozzle opening 21 by covering all of the nozzle openings 21, without performing the suctioning operation using the suctioning device 52.

In addition, though it is not particularly illustrated, the suctioning cap 50 is provided so as to move in the third direction Z, moves to the ink jet recording head 20 side at a desirable timing due to a control of the control unit 11 which will be described later in detail, and comes into contact with the liquid ejecting face 20*a*. In addition, according to the embodiment, it is set so that drying and thickening of ink in the vicinity of the nozzle opening 21 is suppressed using the suctioning cap 50; however, there is no particular limitation to this, and a contact cap which suppresses drying and thickening of ink in the vicinity of the nozzle opening 21 by coming into close contact with the liquid ejecting face 20*a* may be provided separately from the suctioning cap 50.

Figure 10:
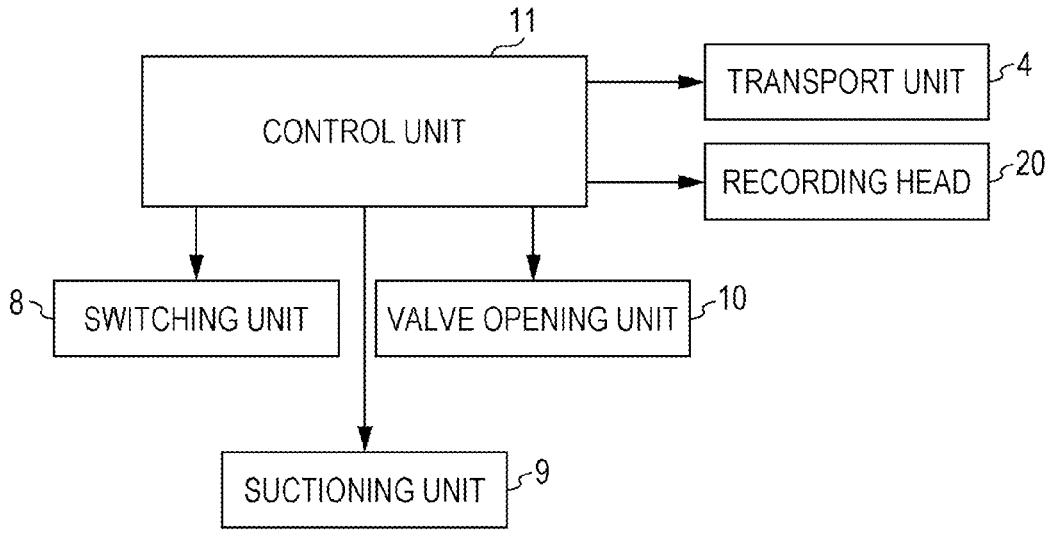
FIG. 10 is a block diagram which illustrates a configuration for controlling the recording apparatus according to the Embodiment 1.

Here, the control unit 11 of the ink jet recording apparatus I will be described. In addition, FIG. 10 is a block diagram which illustrates a controlling configuration of the ink jet recording apparatus.

The control unit 11 controls a position of the recording sheet S by controlling the transport roller 4 which is a transport unit, and causes the ink jet recording head 20 to execute a printing operation by selectively ejecting ink from the nozzle opening 21 based on a driving signal.

In addition, the control unit 11 controls operations of the switching unit 8, the suctioning unit 9, and the valve opening unit 10. Specifically, the control unit 11 switches the connection state of flow paths from the first state to the sixth state by controlling the switching unit 8.

Here, as described above, in the connection state of the switching unit 8, three connection states of the first state, the second state, and the third state are included with respect to the first flow path unit 110, and three connection states of the fourth state, the fifth state, and the sixth state are included with respect to the second flow path unit 120.

In addition, the control unit 11 covers the nozzle opening 21 using the suctioning cap 50 at a desirable timing by controlling the suctioning unit 9, and causes the suctioning device 52 to perform the suctioning cleaning operation in which ink is discharged from the nozzle opening 21 through the suctioning cap 50 by controlling the suctioning device 52.

In addition, the control unit 11 causes the valve opening unit 10 to perform opening of the fifth flow path unit 112, that is, a forcible opening operation in which the first flow path is opened, by moving the valve 32 by controlling the valve opening unit at a desirable timing, regardless of a change in pressure in the pressure chamber 112*a*.

In addition, the control unit 11 performs controls of supplying ink to the ink jet recording head 20 from the liquid storage unit 5, and collecting, cleaning, or the like, of ink, by combining the first to sixth states using the above described switching unit 8, sealing and suctioning cleaning operation of the nozzle opening 21 using the suctioning cap 50 due to the suctioning unit 9, and the forcible valve opening operation using the valve opening unit 10.

Specifically, the control unit 11 controls four modes of the first mode, the second mode, the third mode, and the fourth mode, basically, by combining the switching unit 8, the suctioning unit 9, and the valve opening unit 10 in various ways. Here, each mode will be described with reference to FIGS. 11A to 14B. In addition, FIGS. 11A to 14B are diagrams which schematically illustrate flow path configurations.

Figure 11A:
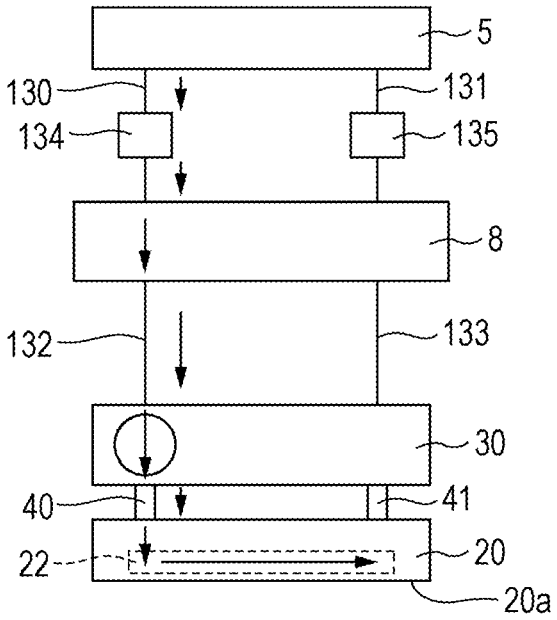
FIGS. 11A and 11B are diagrams which schematically illustrate a flow path configuration denoting each mode according to the Embodiment 1.

As illustrated in FIG. 11A, in the first mode, the control unit 11 causes flow paths to be connected in the first state by controlling the switching unit 8. In the first mode, ink from the liquid storage unit 5 is supplied to the first flow path from the supply path 100 using the pressurizing pump 134. A pressure of the ink which is pressurized using the pressurizing pump 134 is regulated by the pressure regulating unit 30, and the ink is supplied to the ink jet recording head 20. That is, the ink which is pressurized using the pressurizing pump 134 is not supplied to the ink jet recording head 20 in a state in which the valve 32 is closed. In addition, when the ink is ejected from the nozzle opening 21, ink in the manifold 22 is consumed, a pressure in the pressure chamber 112*a* is reduced, and the film 31 is subjected to deflection deformation in the pressure chamber 112*a*. In this manner, when the film 31 presses the valve 32 against the urging force of the spring 33, the fifth flow path unit 112 is opened, and ink is supplied to the manifold 22 from the liquid storage unit 5 through the supply path 100 and the first flow path. In addition, when a pressure in the pressure chamber 112*a* increases due to supplying of ink, the pressure of the film 31 which presses the valve 32 decreases, the valve 32 is urged due to the spring 33, and the fifth flow path unit 112 is closed.

In addition, in the first mode, the switching unit 8 can be set to the fifth state in which the second flow path and the collecting path 101 are connected, or the sixth state in which the second flow path, and the supply path 100 and the collecting path 101 are not connected.

Figure 11B:
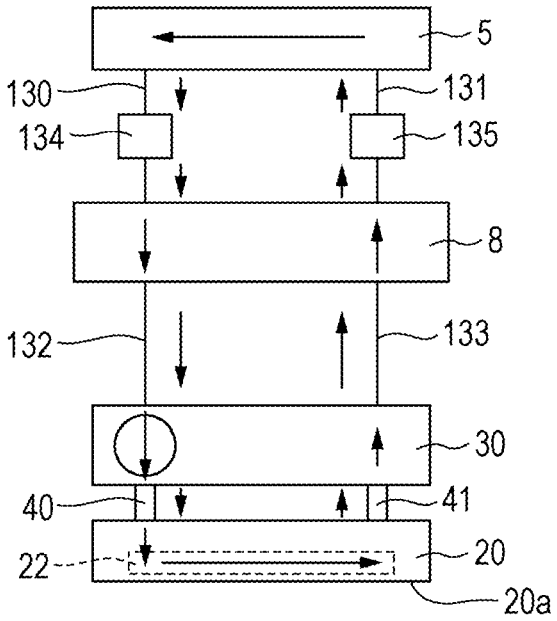

For example, as illustrated in FIG. 11B, in the first mode, when the switching unit 8 is in the fifth state, that is, when the second flow path and the collecting path 101 are connected, ink which is supplied to the manifold 22 from the liquid storage unit 5 is ejected from the nozzle opening 21, and ink which is not ejected from the inside of the manifold 22 can perform so-called circulation in which the ink is collected in the liquid storage unit 5 through the second flow path, that is, the sixth flow path unit 122, the second connecting flow path 123, the fourth flow path unit 121, the second flow path unit 120, and the collecting path 101, due to a suctioning force of the suctioning pump 135.

In addition, as illustrated in FIG. 11A, in the first mode, when the switching unit 8 is in the sixth state, that is, the second flow path, and the supply path 100 and the collecting path 101 are not connected, the circulation is not performed.

In this manner, the connection state on the second flow path side using the switching unit 8 can be changed according to a type of ink. For example, when ink of which an ingredient is easily subsided, or ink in which air bubbles easily occur is used, in the first mode, when the switching unit 8 is set to the fifth state, and ink is circulated between the liquid storage unit 5 and the ink jet recording head 20, it is possible to suppress subsiding of the ingredient in the ink by agitating the ink in the ink jet recording head 20, and to suppress ink ejection failures, or the like, due to residual air bubbles which is caused when the air bubbles are discharged to the liquid storage unit 5. In addition, when ink in which circulation is not necessary is used, in a case of the first mode, circulation of ink may not be performed by setting the switching unit 8 to the sixth state.

The connection state on the second flow path side in the first mode may be automatically determined by the control unit 11 according to a type of ink, for example, or may be manually set by a user, or the like.

Since it is possible to use ink with different properties in the ink jet recording apparatus I in this manner, it is not necessary to prepare a plurality of the ink jet recording apparatuses I with different configurations for each type of ink, and it is possible to reduce costs.

Figure 12:
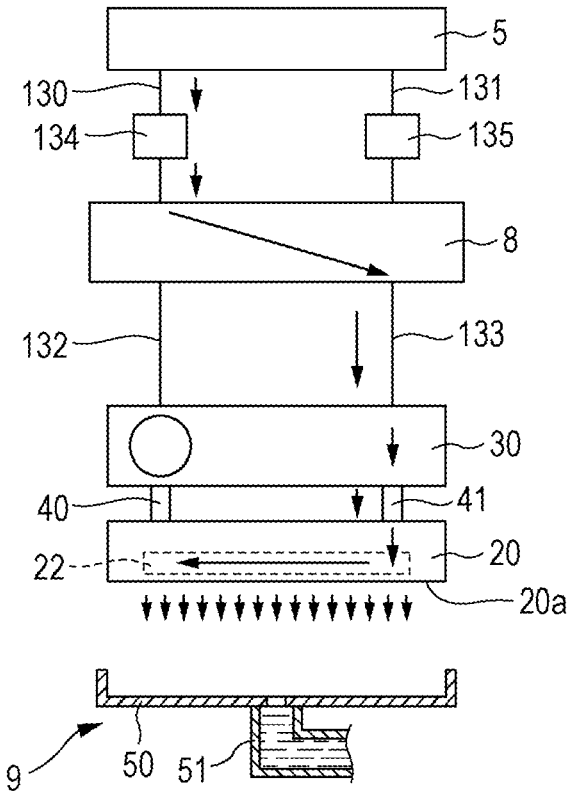
FIG. 12 is a diagram which schematically illustrates the flow path configuration denoting each mode according to the Embodiment 1.

As illustrated in FIG. 12, in the second mode, the control unit 11 causes flow paths to be connected in the fourth state by controlling the switching unit 8. That is, the supply path 100 and the second flow path are connected, ink from the liquid storage unit 5 is pressurized using the pressurizing pump, and is supplied to the manifold 22 through the supply path 100 and the second flow path. Since the valve 32 is not provided in the second flow path, ink which is supplied to the manifold 22 by being pressurized is discharged from the nozzle opening 21, the ink which is discharged from the nozzle opening 21 in this manner may be discharged into the suctioning cap 50. As a matter of course, the ink which is discharged from the nozzle opening 21 may be discharged to a unit other than the suctioning cap 50, without being limited to the suctioning cap 50. In this manner, it is possible to increase a flow rate of ink which is supplied to the manifold 22, and to effectively discharge foreign substances such as air bubbles in the vicinity of the nozzle opening 21.

In the third mode, the suctioning unit 9 is controlled by the control unit 11, and is caused to suction ink from the nozzle opening 21.

Figure 13A:
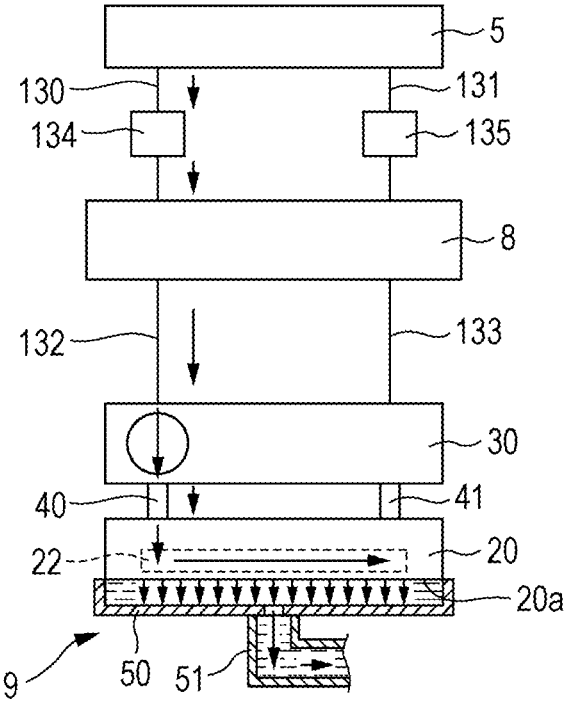
FIGS. 13A and 13B are diagrams which schematically illustrate the flow path configuration denoting each mode according to the Embodiment 1.

In the third mode, the switching unit 8 may be in any one of the first state to the sixth state. For example, as illustrated in FIG. 13A, when the switching unit 8 connects the first flow path and the supply path 100 in the first state, it is possible to supply ink to the manifold 22 in a pressurizing manner through the first flow path while suctioning ink from the nozzle opening 21 using the suctioning unit 9. In addition, for example, it is possible to perform so-called choke cleaning, when the switching unit 8 is changed from the third state, that is, the state in which the first flow path, and the supply path 100 and the collecting path 101 are not connected to the first state, that is, the state in which the first flow path and the supply path 100 are connected, in a state in which ink is suctioned from the nozzle opening 21 using the suctioning unit 9. That is, in the choke cleaning, ink in the first flow path is discharged all at once from the nozzle opening 21 by opening the choke in the first flow path, after increasing a pressure in the first flow path by performing suctioning from the nozzle opening 21 in a state in which the first flow path is choked. In this manner, it is possible to fill the entire first flow path with ink, to suppress a filling failure, and to discharge foreign substances such as trash, air bubbles, or the like, which are not easy to discharge.

Figure 13B:
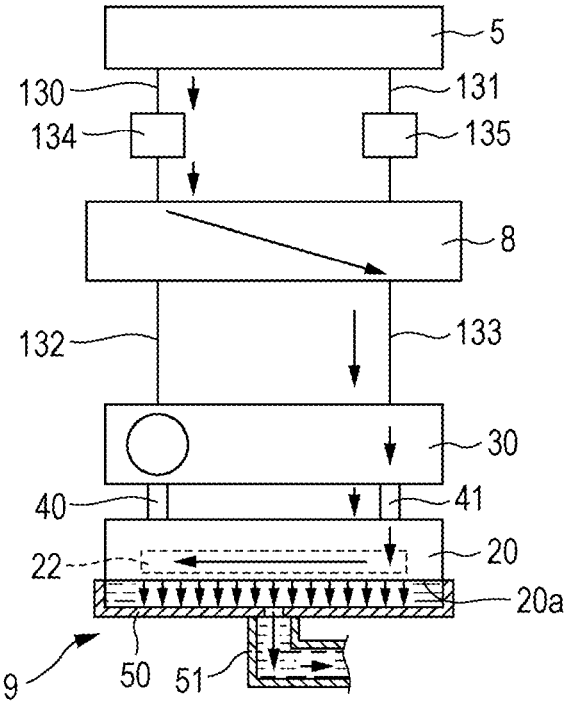

In addition, in the third mode, similarly to the second flow path, for example, when the switching unit 8 connects the second flow path and the supply path 100 in the fourth state, as illustrated in FIG. 13B, it is possible to supply ink to the manifold 22 through the second flow path in a pressurizing manner while suctioning the ink from the nozzle opening 21 using the suctioning unit 9. In addition, similarly to the first flow path, it is possible to perform choke cleaning while performing suctioning using the suctioning unit 9, when the switching unit 8 is switched from the sixth state to the fourth state.

Figure 14A:
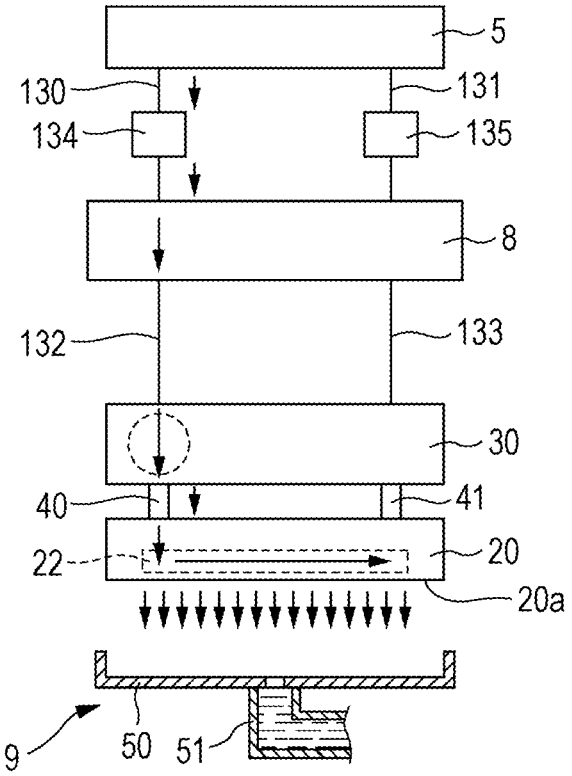
FIGS. 14A and 14B are diagrams which schematically illustrate the flow path configuration denoting each mode according to the Embodiment 1.

In the fourth mode, as illustrated in FIG. 14A, the control unit 11 controls the valve opening unit 10 so as to perform a forcible valve opening operation, and controls the switching unit 8 so as to enter the first state, that is, so as to connect the first flow path and the supply path 100. In this manner, the pressurized ink is supplied to the manifold 22 without being closed using the valve 32. In addition, when the switching unit 8 enters the sixth state, that is, when the second flow path, and the supply path 100 and the collecting path 101 are not connected, the ink which is supplied to the manifold 22 by being pressurized is discharged from the nozzle opening 21. The ink which is discharged from the nozzle opening 21 in this manner may be discharged into the suctioning cap 50. As a matter of course, the ink which is discharged from the nozzle opening 21 may be discharged to a unit other than the suctioning cap 50 without being limited to the suctioning cap 50.

Figure 14B:
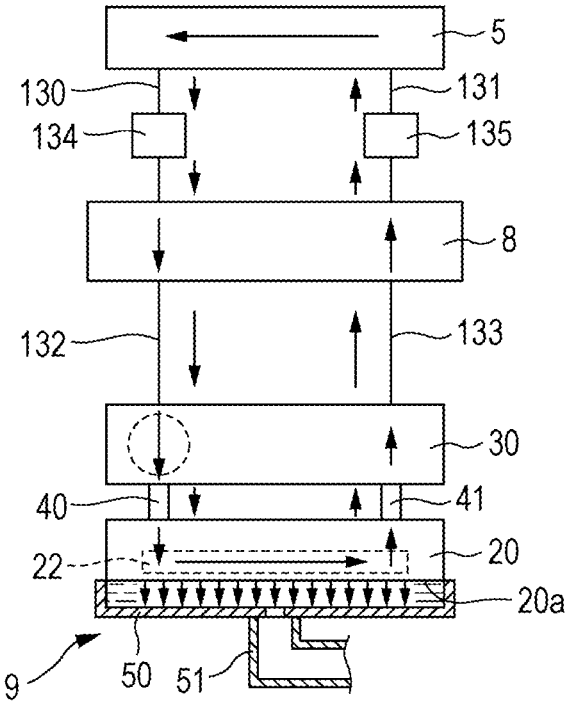

In addition, as illustrated in FIG. 14B, in the fourth mode, it is also possible to collect the ink in the manifold 22 from the second flow path to the liquid storage unit 5 when the suctioning cap 50 seals the nozzle opening 21, and the switching unit 8 enters the fifth state, that is, when the second flow path and the collecting path 101 are connected. In this manner, it is possible to collect sediment, or the like, in the ink jet recording head 20 using circulation. In addition, the suctioning cap 50 in this case may be the above described contact cap, or the like. According to the embodiment, since the suctioning cap 50 takes a role of the contact cap, it is possible to reduce costs by reducing the number of components.

Figure 15:
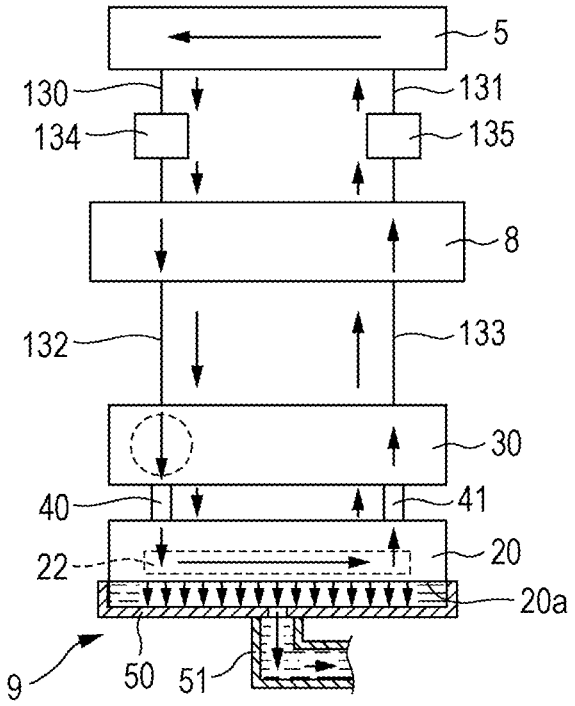
FIG. 15 is a diagram which schematically illustrates the flow path configuration denoting each mode according to the Embodiment 1.

In addition, as illustrated in FIG. 15, the fourth mode and the third mode may be performed at the same time. That is, ink may be supplied in a pressurizing manner through the first flow path using the fourth mode, and at the same time, ink may be suctioned from the nozzle opening 21 using the suctioning unit 9 using the third mode. In this manner, since the cleaning operation using suctioning is also performed, not only the cleaning operation using pressurizing, it is possible to perform cleaning using a large amount of pressure compared to the suctioning cleaning operation using only the suctioning unit 9 or the pressurizing cleaning operation using only the pressurizing pump 134, and to reliably perform eliminating of foreign substances or filling of ink. As a matter of course, the fourth mode may be performed only when it is determined that a filling failure with respect to the ink flow path or a discharging failure of foreign substances such as air bubbles, or the like, occurs, after performing the suctioning cleaning operation using the third mode. In this manner, it is possible to reliably fill the flow path with ink, and to reliably perform discharging of foreign substances such as air bubbles. In addition, when it is sufficient only with the third mode, it is possible to suppress useless consumption of ink by not performing the fourth mode. Incidentally, it is possible to determine the filling failure of ink or the discharging failure of foreign substances such as air bubbles, or the like, by detecting a nozzle opening 21 from which ink is not ejected by causing the nozzle opening 21 to eject ink, for example. That is, since it is understood that a filling failure of ink or a discharging failure of air bubbles occurs when ink is not ejected from the nozzle opening 21 after performing the third mode, the fourth mode may be performed.

In this manner, the control unit 11 can perform supplying, collecting, and initial filling of ink, the cleaning operation, and the like, by performing operations based on the four modes of the first mode, the second mode, the third mode, and the fourth mode using a single mode, or by combining the modes.

Here, the initial filling of ink means that it is a state in which the ink jet recording head 20 is not filled with ink which is used for ejecting. That is, the inside of the ink jet recording head 20 is empty, or is in a state of being filled with liquid for storage (storage liquid). In this manner, newly filling the empty ink jet recording head 20 with ink, or filling of ink by discharging storage liquid is referred to as the initial filling of ink (liquid).

At a time of the initial filling of ink, for example, ink may be suctioned from the nozzle opening 21 using the third mode, after filling of ink, by supplying the ink to the second flow path in a pressurizing manner using the second mode. In this manner, finally, in the initial filling of ink, when the suctioning unit 9 performs suctioning from the nozzle opening 21 using the third mode, it is possible to effectively discharge pushed air bubbles to the outside using suctioning even when the air bubbles are pushed into a corner of the flow path, and are not discharged, when being supplied in a pressurizing manner using the second mode. Particularly, in the first flow path in which the valve 32 is provided, there is not enough space between the shaft portion 32*a* of the valve 32 and the through hole 112*b*, and it is not possible to obtain a large flow rate; however, it is possible to obtain a large flow rate, and to fill the first flow path with ink by filling the inside of the flow path with ink through the second flow path using the second mode. In addition, when the third mode is performed in the initial filling of ink, the switching unit 8 may be in the sixth state in which the second flow path, and the supply path 100 and the collecting path 101 are not connected, or may be in the fourth state or the fifth state in which the second flow path and the supply path 100, or the collecting path 101 are connected. In addition, when the third mode is performed in the initial filling of ink, the first mode may be performed between the second mode and the third mode. As a matter of course, the third mode and the first mode may be performed at the same time.

In addition, in the cleaning operation, the control unit 11 can effectively discharge foreign substances such as air bubbles in a desired flow path by putting a connection state of the switching unit 8, other modes, or the like, in the third mode. For example, when foreign substances in the inside of the individual flow path (not illustrated) are discharged, the switching unit 8 may connect the first flow path and the supply path 100 which is the first state, and may connect the second flow path and the supply path 100 which is the fourth state. As a matter of course, it may be the fifth state, that is, the state in which the second flow path and the collecting path 101 are connected, not the fourth state; however, in this case, it is necessary to stop the operation of the suctioning pump. In addition, here, the first state using the switching unit 8 is the first mode, that is, the state in which ink is supplied in a pressurizing manner through the first flow path; however, as a matter of course, foreign substances may be discharged using only a suctioning force of the suctioning unit by stopping the operation of the pressurizing pump.

In addition, when foreign substances in the vicinity of the valve or the filter 136 are discharged, the switching unit 8 may connect the first flow path and the supply path 100 which is the first state, or may not connect the second flow path, and the supply path 100 and the collecting path 101 which is the sixth state. In this manner, since a pressure of suctioning using the suctioning unit is not applied to the second flow path, and is applied only to the first flow path side, it is possible to efficiently discharge foreign substances in the first flow path, that is, in the vicinity of the valve or the filter 136 without uselessly consuming ink.

In addition, when foreign substances in the second flow path are desired to be discharged, the switching unit 8 may not connect the first flow path, and the supply path 100 and the collecting path 101 which is the third state, and may connect the second flow path and the supply path 100 which is the fourth state. Due to this, since a pressure of suctioning of the suctioning unit is not applied to the first flow path, and is applied only to the second flow path side, it is possible to efficiently discharge foreign substances in the second flow path without uselessly consuming ink.

In this manner, the control unit can efficiently perform supplying of ink which is performed while circulating the ink in the ink jet recording head, supplying of ink at a normally constant pressure by regulating the pressure using the valve without circulating the ink, initial filling of ink, eliminating of foreign substances, and the like.

In addition, according to the embodiment, the control unit causes operations based on the four modes of the first mode, the second mode, the third mode, and the fourth mode to be performed; however, there is no particular limitation to this, and there may be another mode by combining the first to sixth states using the switching unit 8, a suctioning operation using the suctioning unit, sealing of the nozzle opening 21 using the suctioning cap, the forcible valve opening operation using the valve opening unit, and the like.

Other Embodiments

Hitherto, the embodiment of the present invention has been described; however, the basic configuration of the present invention is not limited to the above described embodiment.

For example, in the above described embodiment 1, one liquid storage unit 5 is connected to a plurality of ink jet recording heads 20; however, there is no particular limitation to this, and the liquid storage unit 5 may be connected to each ink jet recording head 20, individually, or in each group.

In addition, in the above described embodiment 1, the configuration in which the ink jet recording head 20 and the pressure regulating unit 30 are connected using the first connecting pipe 40 and the second connecting pipe 41 has been exemplified; however, there is no particular limitation to this, and the ink jet recording head 20 and the pressure regulating unit 30 may be integrally provided.

In addition, in the above described embodiment 1, the suctioning unit 9 is provided in the ink jet recording apparatus I; however, the suctioning unit 9 may not necessarily be provided, and the present invention can be applied to an ink jet recording apparatus I in which the suctioning unit 9 is not provided.

In addition, in the above described embodiment 1, the valve opening unit 10 is provided in the ink jet recording apparatus I; however, the valve opening unit 10 may not necessarily be provided, and the present invention can be applied to an ink jet recording apparatus I in which the fourth mode is not performed without including the valve opening unit 10.

In addition, in the above described embodiment 1, the control unit 11 determines whether or not to perform the second mode after performing the third mode; however, there is no particular limitation to this, and for example, the control may be performed depending on an elapsed amount of time, or the like. That is, it may be a configuration in which only the third mode is performed before the passage of a certain amount of time, and the second mode is performed after the third mode, only when a certain amount of time has passed.

In addition, in the above described embodiment 1, the third mode is performed after performing the second mode when performing initial filling of ink; however, as a matter of course, there is no limitation to this, and the initial filling may be performed by combining each mode or switching states.

In addition, in the above described embodiment 1, circulation can be performed in the first mode, or the like, by providing the suctioning pump 135 for circulation; however, the suctioning pump 135 for circulation is not essential, and it is also possible to apply the present invention to an ink jet recording apparatus I in which the suctioning pump 135 is not provided.

In addition, in the liquid storage unit 5, a heating unit such as a heater which heats stored ink may be provided. That is, heated ink may be supplied to the ink jet recording head 20. In addition, the heating unit may be provided in the supply path 100, or the like, and may be provided in the ink jet recording head 20. In particular, when circulation is performed in the first mode, it is possible to stably maintain a temperature of ink in the manifold 22 regardless of the amount of ink which is not ejected.

In addition, in the above described example, only one head unit 2 which includes the plurality of ink jet recording heads 20 is provided in the ink jet recording apparatus I; however, two or more head units 2 may be mounted on the ink jet recording apparatus I. That is, the control unit 11 may control supplying of ink from the liquid storage unit 5 to the head unit 2, collecting, cleaning, and the like, of ink by putting the first to sixth states using the switching unit 8, sealing of the nozzle opening 21 and the suctioning cleaning operation using the suctioning cap 50, using the suctioning unit 9, and the forcible valve opening operation using the valve opening unit 10 together. For example, in the first mode, the fifth state in which the second flow path and the collecting path 101 are connected may be set with respect to the first head unit 2, and the sixth state in which the second flow path, and the supply path 100 and the collecting path 101 are not connected may be set with respect to the second head unit 2. In addition, the second mode may be performed with respect to the second head unit 2 while performing the first mode with respect to the first head unit 2.

In addition, the ink jet recording head 20 may be directly mounted on the ink jet recording apparatus I. In addition, the liquid storage unit 5 may not be mounted on the ink jet recording apparatus.

In addition, in the above described example, a so-called line-type ink jet recording apparatus I in which the ink jet recording head 20 is fixed, and printing is performed only by transporting a recording sheet S is exemplified; however, there is no particular limitation to this. For example, it is also possible to apply the present invention to a so-called serial-type ink jet recording apparatus in which the ink jet recording head 20 is mounted on a carriage which moves in the main scanning direction intersecting a transport direction of a recording sheet S, and printing is performed while moving the ink jet recording head 20 in the main scanning direction.

In addition, the present invention is for overall liquid ejecting apparatuses in wide use, and can also be applied to a liquid ejecting apparatus which includes, for example, a recording head of various ink jet recording heads which are used in an image recording apparatus such as a printer, a coloring material ejecting head which is used when manufacturing a color filter such as a liquid crystal display, an electrode material ejecting head which is used when forming electrodes of an organic EL display, a field emission display (FED), or the like, and a bioorganic material ejecting head, or the like, which is used when manufacturing a biochip.

What is claimed is:

1. A liquid ejecting apparatus comprising:

a liquid ejecting head which communicates with a nozzle opening which ejects liquid, and includes individual flow paths which are arranged in a line along a first direction, and a manifold which communicates with a plurality of the individual flow paths;

a first flow path which is connected to one end side of the first direction of the manifold;

a second flow path which is connected to the other end side of the first direction of the manifold;

a switching unit which switches a communication state between a liquid storage unit in which liquid is stored and the respective first and second flow paths;

a pressure regulating unit in fluid communication with the first flow path, which is provided between the switching unit of the first and second flow paths and the liquid ejecting head, and includes a valve which is open due to negative pressure on the manifold side of the first flow path;

a pressure-feeding unit which sends liquid in a pressurizing manner toward the switching unit from the liquid storage unit; and a control unit which controls the switching unit, wherein the control unit is capable of performing switching between a first mode in which liquid is supplied to the manifold through the valve by causing the liquid storage unit and the first flow path to communicate with the switching unit and a second mode in which liquid is supplied to the manifold without going through the valve by causing the liquid storage unit and the second flow path to communicate with the switching unit.

2. The liquid ejecting apparatus according to claim 1, further comprising:

a suctioning unit which suctions liquid from the nozzle opening, wherein the control unit performs a third mode in which liquid is discharged from the nozzle opening using the suctioning unit.

3. The liquid ejecting apparatus according to claim 2, wherein the control unit determines whether or not to perform the second mode after performing the third mode.

4. The liquid ejecting apparatus according to claim 2, wherein the control unit performs the third mode after supplying liquid to the second flow path using the second mode, when performing initial filling with respect to the liquid ejecting head.

5. The liquid ejecting apparatus according to claim 1, further comprising:

a valve opening unit which opens the valve regardless of pressure in the first flow path, wherein the control unit performs a fourth mode in which the valve is opened using the valve opening unit, liquid is supplied to the switching unit from the first flow path, and the liquid is supplied to the liquid ejecting head from the first flow path.

6. The liquid ejecting apparatus according to claim 5, further comprising:

a cap which seals the nozzle opening, wherein the control unit collects the liquid which is supplied from the first flow path to the liquid ejecting head from the second flow path by sealing the nozzle opening using the cap in a case of the fourth mode.

7. The liquid ejecting apparatus according to claim 1, further comprising:

a circulation pump, wherein the control unit allocates the liquid which is supplied from the first flow path to ejection of liquid from the nozzle opening of the liquid ejecting head, and to collection from the second flow path, in a case of the first mode.

8. The liquid ejecting apparatus according to claim 1, further comprising:

a supply path and a collecting path which communicate with the switching unit and the liquid storage unit, wherein the switching unit performs switching between a first state in which the first flow path and the supply path are connected, a second state in which the first flow path and the collecting path are connected, and a third state in which the first flow path, and the supply path and the collecting path are not connected.

9. The liquid ejecting apparatus according to claim 1, further comprising:

a supply path and a collecting path which communicate with the switching unit and the liquid storage unit, wherein the switching unit performs switching between a fourth state in which the second flow path and the supply path are connected, a fifth state in which the second flow path and the collecting path are connected, and a sixth state in which the second flow path, and the supply path and the collecting path are not connected.

10. The liquid ejecting apparatus according to claim 1, further comprising:

a pressure-feeding unit which is provided between the switching unit and the liquid storage unit.

11. The liquid ejecting apparatus according to claim 1, further comprising:

a filter which is provided in the first flow path, and which eliminates foreign substances included in liquid.

12. The liquid ejecting apparatus according to claim 1, wherein the switching unit selects whether or not to cause the liquid storage unit and the second flow path to communicate with each other according to a type of liquid, in the first mode.

13. The liquid ejecting apparatus according to claim 11, wherein the switching unit causes the liquid storage unit and the second flow path to communicate with each other when an ingredient contained in liquid is easy to subside, and does not cause the liquid storage unit and the second flow path to communicate with each other when an ingredient contained in liquid is not easy to subside.

14. A control method of a liquid ejecting apparatus which includes a liquid ejecting head which communicates with a nozzle opening which ejects liquid, and includes individual flow paths which are arranged in a line along a first direction, and a manifold which communicates with a plurality of the individual flow paths;

a first flow path which is connected to one end side of the first direction of the manifold;

a second flow path which is connected to the other end side of the first direction of the manifold;

a switching unit which switches a communication state between a liquid storage unit in which liquid is stored and the respective first and second flow paths;

a pressure regulating unit in fluid communication with the first flow path, which is provided between the switching unit of the first and second flow paths and the liquid ejecting head, and includes a valve which is open due to negative pressure on the manifold side of the first flow path;

a pressure-feeding unit which sends liquid in a pressurizing manner toward the switching unit from the liquid storage unit; and a control unit which controls the switching unit, wherein the control unit performs a control so that a first mode in which liquid is supplied to the manifold through the valve by causing the liquid storage unit and the first flow path to communicate with the switching unit and a second mode in which liquid is supplied to the manifold without going through the valve by causing the liquid storage unit and the second flow path to communicate with the switching unit can be switched.

* * * * *